US012281413B2

(12) United States Patent
Tanaka

(10) Patent No.: US 12,281,413 B2
(45) Date of Patent: Apr. 22, 2025

(54) WOUND YARN PACKAGE AND MANUFACTURING METHOD THEREOF

(71) Applicant: UBE EXSYMO CO., LTD., Tokyo (JP)

(72) Inventor: Seiji Tanaka, Tokyo (JP)

(73) Assignee: UBE EXYSMO CO., LTD., Tokyo (JP)

( * ) Notice: Subject to any disclaimer, the term of this patent is extended or adjusted under 35 U.S.C. 154(b) by 101 days.

(21) Appl. No.: 17/767,922

(22) PCT Filed: Oct. 16, 2020

(86) PCT No.: PCT/JP2020/039089
§ 371 (c)(1),
(2) Date: Apr. 11, 2022

(87) PCT Pub. No.: WO2021/085183
PCT Pub. Date: May 6, 2021

(65) Prior Publication Data

US 2024/0092608 A1 Mar. 21, 2024

(30) Foreign Application Priority Data

Oct. 29, 2019 (JP) ..... 2019-195835

(51) Int. Cl.
*B65H 55/04* (2006.01)
*D01D 10/04* (2006.01)

(52) U.S. Cl.
CPC ..... *D01D 10/0409* (2013.01); *B65H 55/04* (2013.01); *B65H 2701/37* (2013.01)

(58) Field of Classification Search
CPC .... B65H 49/16; B65H 75/16; B65H 2701/31; B65H 55/04; B65H 54/06; B65H 54/04;
(Continued)

(56) References Cited

U.S. PATENT DOCUMENTS 3,589,643 A * 6/1971 Takizawa ..... B65H 54/2851 242/482.9
3,598,338 A * 8/1971 Brushenko ..... B65H 54/04 242/157 R (Continued)

FOREIGN PATENT DOCUMENTS

EP 1443009 A1 8/2004
JP S59108656 A 6/1984

(Continued)

*Primary Examiner* — Amy Vanatta
(74) *Attorney, Agent, or Firm* — HAUPTMAN HAM, LLP

(57) ABSTRACT

To provide a wound yarn package and a method for manufacturing the same in which even if sea-island type fibers are wound around a bobbin one by one by a traverse mode, cob-webbing and curling are less likely to occur, and the variation in the heat shrinkage rate between layers constituting the yarn layer is reduced. When winding sea-island type fibers with a fineness of 100 to 6400 dtex around a bobbin one by one by a traverse mode to form a yarn layer, each yarn constituting the n-th yarn layer is wound at a position 0 to x mm away from each yarn constituting the (n−1)-th yarn layer, with the yarn width of the sea-island type fiber being taken as x (mm), to fabricate a wound yarn package.

3 Claims, 5 Drawing Sheets

(58) Field of Classification Search
CPC ..... B65H 54/026; B65H 54/08; B65H 54/10; B65H 54/28; B65H 54/38; B65H 54/02–54/553; B65H 55/00; B65H 55/005; B65H 57/16; D05C 15/18; D01D 10/0409; D02H 3/00; D02H 3/02; D02H 5/00
USPC ..... 28/284–291
See application file for complete search history.

(56) References Cited

U.S. PATENT DOCUMENTS 4,107,374 A * 8/1978 Kusunose ..... D04H 3/16 442/407
5,549,781 A * 8/1996 Schotter ..... B65H 54/00 156/169
2011/0248112 A1* 10/2011 Corbett ..... B65H 49/08 242/174
2015/0185428 A1 7/2015 Tani et al.
2020/0165097 A1* 5/2020 Purkis ..... G02B 6/4458
2020/0399092 A1* 12/2020 Tanaka ..... B65H 55/04

FOREIGN PATENT DOCUMENTS

JP 3-147675 * 6/1991
JP 2000272825 A 10/2000
JP 2001327817 A * 11/2001
JP 2001335239 A 12/2001
JP 2011207597 A 10/2011
JP 201337253 A 2/2013
JP 6078754 B2 * 2/2017
JP 2017214185 A 12/2017
JP 2018177412 A 11/2018
WO 03040011 A1 5/2003
WO WO-2008125965 A2 * 10/2008 ..... B65H 54/2851
WO 2014024720 A1 2/2014

* cited by examiner

WOUND YARN PACKAGE AND MANUFACTURING METHOD THEREOF

CROSS-REFERENCE TO RELATED APPLICATIONS

The present application is a National Phase of International Application No. PCT/JP2020/039089 filed Oct. 16, 2020, which claims the benefit of priority from the prior Japanese patent application No. 2019-195835 filed on Oct. 29, 2019.

TECHNICAL FIELD

The present invention relates to a wound yarn package in which a yarn is wound around a bobbin and a method for manufacturing the same. More specifically, the present invention relates to a technique for manufacturing a wound yarn package by traverse-winding a composite fiber around a bobbin.

BACKGROUND ART

In general, when a tape-shaped or yarn-shaped wire is wound around a core material such as a bobbin to form a package, a traverse winding in which the wire is wound while reciprocating the wire in the axial direction of the core material is adopted. Further, a wound yarn package has also been conventionally proposed in which the winding method and the winding conditions are devised to prevent cob-webbing and improve reelability (see Patent Literatures 1 to 3). For example, in the yarn winding method described in Patent Literature 1, a yarn is wound at a winding ratio in which the wound yarn is dispersed and laminated evenly over the entire winding width such that the yarn winding trajectory is not biased.

In the method for winding a single yarn thick multifilament described in Patent Literature 2, the winding tension and the twill angle at the time of winding are set to specific ranges, and the winding ratio is switched once or more so that the value obtained by dividing the package winding width by the number of ribbons is in the range of 3 to 5. Further, in the package described in Patent Literature 3, the initial winding width is set to a specific range with a thermoplastic fiber having a low yarn-yarn friction coefficient, and the twill angle is gradually increased from the start to the end of the winding so that the difference ($\theta 2-\theta 1$) between the twill angle $\theta 2$ at the end of winding and the twill angle $\theta 1$ at the start of winding is in the range of 4.0° to 7.0°.

A method for eliminating defects related to tension fluctuation during high-speed reeling, a heat shrinkage property derived from the ears of the package, a fineness fluctuation property and a crimping property, and the defect of periodic dyeing spots in the yarn length direction, in a polyester-based composite fiber package obtained by winding a polyester-based composite fiber by a one-stage melt-spinning method, has also been conventionally proposed (see, Patent Literature 4). In the manufacturing method described in Patent Literature 4, a composite fiber melt-spun using a spinneret in which the ratio (L/D) of the hole diameter D to the hole length L of a discharge hole is 2 or more and the discharge outlet hole is tilted by 10 to 40° with respect to the vertical direction is cooled and solidified by cooling air, then, wound at a specific spinning tension, heat treatment temperature, heat treatment tension, package temperature at the time of winding, and winding speed without being stretched.

CITATION LIST

Patent Literatures

Patent Literature 1: JP 2001-335239 A
Patent Literature 2: JP 2011-207597 A
Patent Literature 3: JP 2017-214185 A
Patent Literature 4: WO 2003/040011 A1

SUMMARY OF INVENTION

Technical Problem

A sea-island type fiber which is formed of two or more kinds of resins and has a cross-sectional structure in which island components are scattered in the sea component can be manufactured, for example, by integrating dozens to hundreds of melt-spun single fibers by heat-stretching or heating. The sea-island type fiber manufactured by such method has a problem that the sea component shrinks and curling occurs in the yarn of the lower layer due to the after-cure performed after the winding and the change with time, since the fiber is wound in a state where the crystallization of the sea component has not sufficiently progressed.

If large curling is present in the yarn layer of the wound yarn package, problems such as "a poor reeling trouble occurs at the time of unwinding", "the curling part becomes an irregular pattern during the weaving process, and the design of the woven fabric deteriorates", "the Young's modulus of the yarn decreases", and the like, occur. In addition, due to the above-mentioned curling, there will be a difference in the apparent heat shrinkage rate between the outermost yarn layer and the innermost yarn layer of the wound yarn package made of the sea-island type fiber, and when heat pressing is performed after the weaving process, "warp" or "bending" may occur, causing problems such as poor physical properties of the manufactured product.

Regarding these problems, the techniques described in Patent Literatures 1 to 3 described above can improve cob-webbing, but cannot improve the variation in the heat shrinkage rate due to the curling. On the other hand, the technique described in Patent Literature 4 specifies the discharge conditions at the time of spinning, the spinning tension, the package temperature at the time of winding, the winding speed, and the like, in order to solve a problem caused by a difference in winding diameter between the ear portion and the central portion, thus, this method cannot solve the problem that the heat shrinkage rate varies between the upper yarn layer and the lower yarn layer.

Then, the present invention has an object of providing a wound yarn package and a method for manufacturing the same in which even if sea-island type fibers are wound around a bobbin one by one by a traverse mode, cob-webbing and curling are less likely to occur, and the variation in the heat shrinkage rate between the layers constituting the yarn layer is reduced.

Solution to Problem

The wound yarn package according to the present invention has a bobbin, and a yarn layer formed by winding sea-island type fibers having a fineness of 100 to 6400 dtex one by one around the bobbin by a traverse mode, in which each yarn constituting the n-th (n is an integer of 2 or more) yarn layer is wound at a position 0 to x mm away from each yarn constituting the (n−1)-th yarn layer, with the yarn width of the sea-island type fiber being taken as x (mm).

The sea-island type fiber has a heat shrinkage rate of 2% or less at a temperature lower by 20° C. than the melting point mp of a sea component.

The sea-island type fiber can be tape-shaped or have an elliptical cross section.

The method for manufacturing a wound yarn package according to the present invention has a winding step for winding sea-island type fibers with a fineness of 100 to 6400 dtex around a bobbin one by one by a traverse mode, in which in the winding step, each yarn constituting the n-th (n is an integer of 2 or more) yarn layer is wound at a position 0 to x mm away from each yarn constituting the (n−1)-th yarn layer, with the yarn width of the sea-island type fiber being taken as x (mm).

In the method for manufacturing a wound yarn package according to the present invention, the yarn layer may be heated for 6 hours or more under a temperature condition of 40 to 120° C. after the winding step.

Further, as the sea-island type fiber, one which is tape-shaped or has an elliptical cross section may be used.

Advantageous Effects of Invention

According to the present invention, a wound yarn package is obtained in which even if sea-island type fibers are wound around a bobbin one by one by a traverse mode, cobwebbing and curling are less likely to occur, and the heat shrinkage rate is uniform between layers constituting the yarn layer.

DESCRIPTION OF EMBODIMENTS

Embodiments for carrying out the present invention will be described in detail below with reference to the accompanying drawings. However, the present invention is not limited to the embodiments described below.

Figure 1:
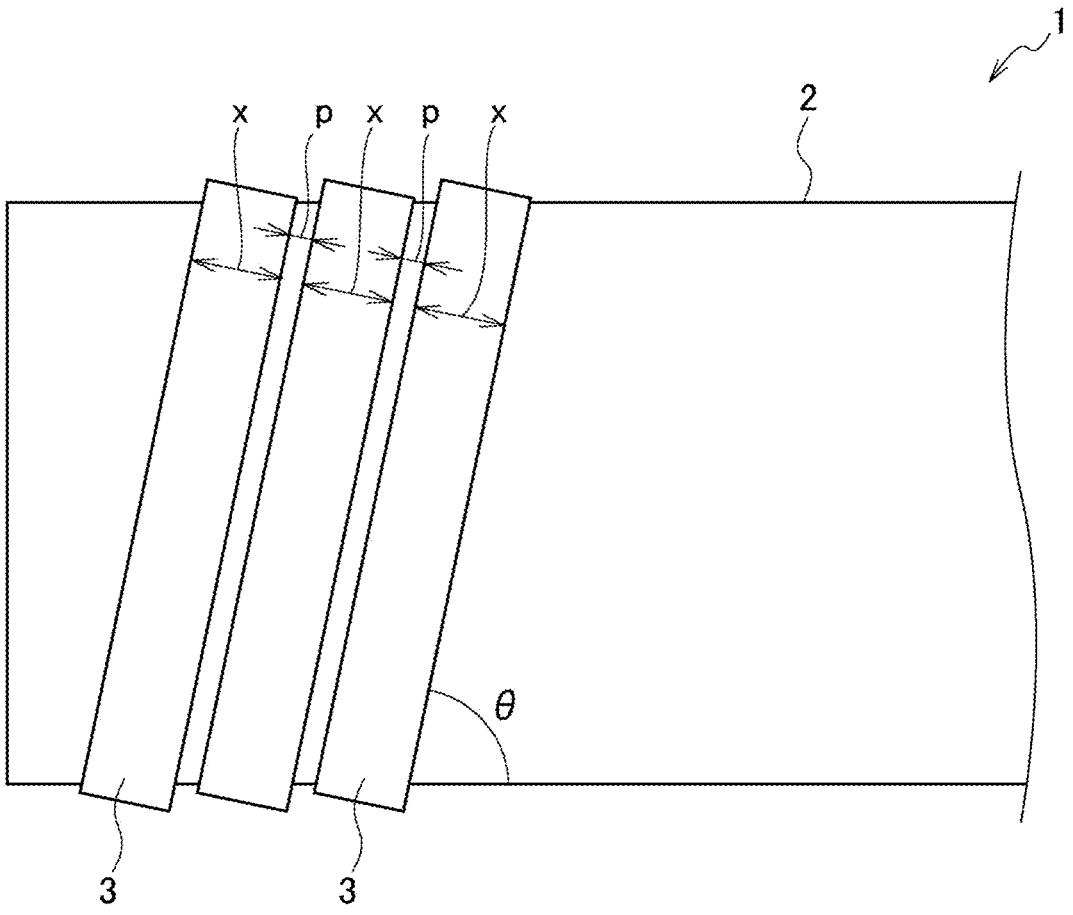
FIG. 1 is an enlarged side view schematically showing a wound state of a sea-island type fiber in a wound yarn package according to an embodiment of the present invention.
Figure 2A:
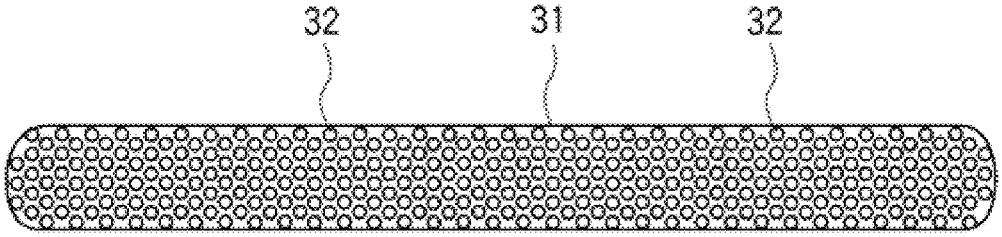
FIGS. 2A and 2B are views schematically showing a cross section of a sea-island type fiber 3, where A is a tape-shaped yarn and B is a yarn having an elliptical cross section.
Figure 2B:
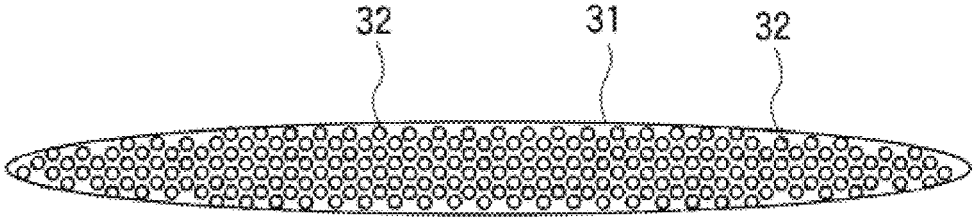

FIG. 1 is an enlarged side view schematically showing a wound state of a sea-island type fiber in a wound yarn package according to an embodiment of the present invention, and FIGS. 2A and 2B are views schematically showing a cross section of a sea-island type fiber 3. As shown in FIG. 1, the wound yarn package 1 of the present embodiment is constituted of a bobbin 2 and a yarn layer formed by winding the sea-island type fiber 3 around the bobbin 2.

[Bobbin 2]

As the bobbin 2, a tubular article made of paper, plastic or metal such as an aluminum alloy can be used. The size of the bobbin 2 is not particularly limited, and can be appropriately set according to the length, thickness, material, and the like of the yarn to be wound.

[Yarn Layer]

The yarn layer is made of two or more types of resins, has a cross-sectional structure in which island components are scattered in the sea component, and is formed by winding sea-island type fibers 3 having a fineness of 100 to 6400 dtex around a bobbin 2 one by one by a traverse mode. When the fineness of the sea-island type fiber 3 constituting the yarn layer is less than 100 dtex, almost no variation in physical properties is observed between the layers, and it is difficult to realize the effect of making the heat shrinkage rate uniform. Further, when the fineness of the sea-island type fiber 3 exceeds 6400 dtex, a swelling occurs at the end portion of the yarn layer, and the winding collapse is likely to occur.

As the sea-island type fiber 3 constituting the yarn layer, for example, a tape-shaped yarn as shown in FIG. 2A or a yarn having an elliptical cross section as shown in FIG. 2B can be used. These sea-island type fibers 3 are obtained by integrating dozens to hundreds of melt-spun single fibers by fusion or heat welding into one yarn, and as the single fiber forming the sea-island type fiber 3, for example, a composite fiber made of two or more types of thermoplastic resins having different melting points can be used.

Figure 3A:
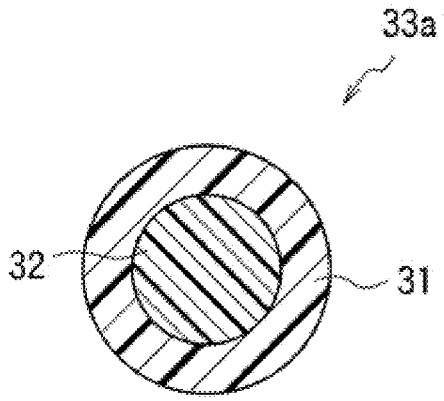
FIGS. 3A to 3C are cross-sectional views showing structural examples of composite fibers (single fibers), where A is a sheath-core composite type, B is an eccentric sheath-core type, and C is a side-by-side type.
Figure 3B:
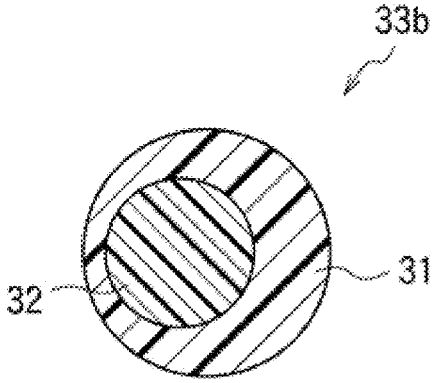
Figure 3C:
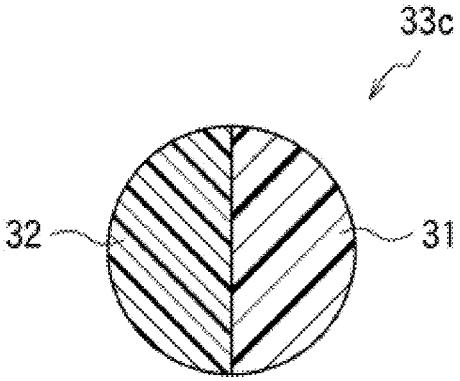

FIGS. 3A to 3C are cross-sectional views showing a structural example of a composite fiber (single fiber) used as a raw material for the sea-island type fiber 3, in which FIG. 3A is a sheath-core type, FIG. 3B is an eccentric sheath-core type, and FIG. 3C is a side-by-side type. The composite fibers 33*a*, 33*b*, 33*c* are constituted of a first resin component (hereinafter, referred to as a low melting point component 31) and a second resin component having a melting point higher than that of the first resin component by 20° C. or more (hereinafter, referred to as a high melting point component 32), and in the case of the sheath-core type composite fiber 33*a* shown in FIG. 3A and the eccentric sheath-core type composite fiber 33*b* shown in FIG. 3B, in general, the sheath portion is formed of the low melting point component 31, and the core portion is formed of the high melting point component 32.

For example, when the sheath-core type composite fiber 33*a* shown in FIG. 3A or the eccentric sheath-core type composite fiber 33*b* shown in FIG. 3B is used as the single fiber, the sea-island type fiber 3 has a cross-sectional structure in which islands made of the high melting point component 32 are scattered in the sea part made of the low melting point component 31, as shown in FIGS. 2A and 2B. The single fiber forming the sea-island type fiber 3 is not limited to the above-mentioned composite fiber, and two or more kinds of single fibers made of a single resin may be used, and the single fiber and the composite single fiber may be used in combination. Further, as the composite fiber, those having structures other than those shown in FIGS. 3A to 3C, such as a multi-core type composite fiber, can also be used.

The sea-island type fiber 3 constituting the yarn layer preferably has a heat shrinkage rate of 2% or less at a temperature (mp-20° C.) lower by 20° C. than the melting point mp of the sea component (low melting point component 31). As a result, it is possible to suppress product shrinkage during post-processing such as molding press processing, and further reduce product dimensional errors caused by post-processing. The heat shrinkage rate of the sea-island type fiber 3 herein referred to is a value in the finished product after all the steps are completed, and the value at the time of winding may exceed 2% providing the heat shrinkage rate becomes 2% or less by heating after winding (after cure).

Further, as shown in FIG. 1, in the wound yarn package 1 of the present embodiment, when the yarn width of the sea-island type fiber 3 is taken as x (mm), each yarn constituting the n-th (n is an integer of 2 or more) yarn layer is wound at a position 0 to x mm away from each yarn constituting the (n−1)-th yarn layer. That is, in the wound yarn package 1 of the present embodiment, the distance between the n-th layer yarn and the (n−1)-th layer yarn (hereinafter, also referred to as pitch) is 0 to x mm. As a result, the unevenness of layers constituting the yarn layer becomes smaller, so that the occurrence of cob-webbing can be suppressed, and the surface of the yarn layer becomes uneven due to heat shrinkage after manufacturing, thus, the occurrence of curling and variations in the heat shrinkage rate can be prevented.

Here, the distance (pitch p) between the n-th layer yarn and the (n−1)-th layer yarn is preferably 0 to 0.5 x mm, and under this condition, the effect of suppressing the occurrence of cob-webbing and curling can be enhanced, and the heat shrinkage rate of the yarn layer can be made uniform. The fact that the pitch p between the n-th layer yarn and the (n−1)-th layer yarn is 0 mm means that the yarn is wound without a gap with respect to the yarn wound in the previous cycle.

[Manufacturing Method]

Figure 4:
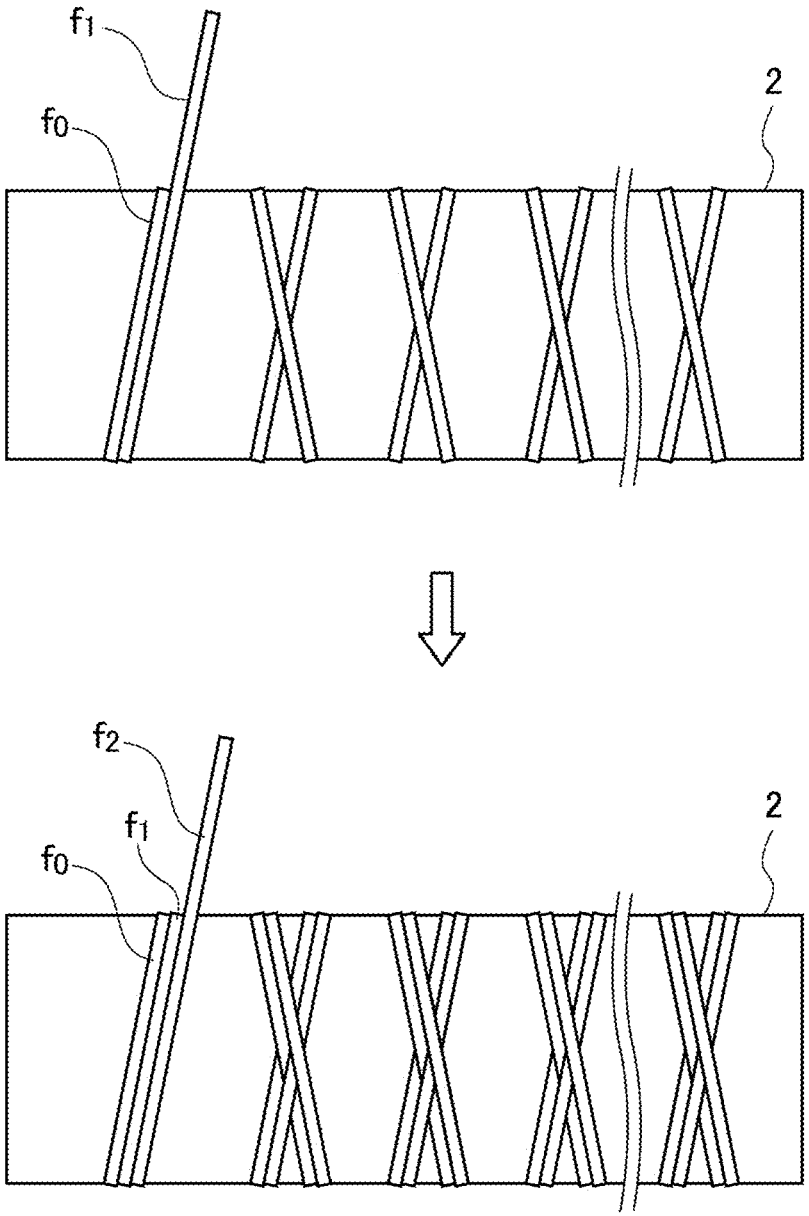
FIG. 4 is a side view schematically showing a method for manufacturing a wound yarn package according to an embodiment of the present invention.

Next, the method for manufacturing the wound yarn package 1 described above will be described. FIG. 4 is a view schematically showing a method for manufacturing the wound yarn package 1 according to the embodiment of the present invention. As shown in FIG. 4, in the method for manufacturing the wound yarn package 1 of the present embodiment, a winding step of winding the sea-island type fibers 3 one by one around the bobbin 2 by a traverse mode is carried out. The sea-island type fiber 3 used at that time is not particularly limited as long as it is made of two or more kinds of thermoplastic resins having different melting points, has a fineness of 100 to 6400 dtex, and has a sea-island structure in the cross section, however, the tape-shaped yarn shown in FIG. 2A or the yarn having an elliptical cross section shown in FIG. 2B is preferable from the viewpoint of the magnitude of the effect.

In the wound yarn package 1 of the present embodiment, it is also possible to adopt a multifilament in which a plurality of composite fibers (single fibers) are combined into one yarn (bundle), instead of monofilaments such as the tape-shaped yarn or the yarn having an elliptical cross section described above. However, in the wound yarn package using the multifilament, the individual composite fibers (single fibers) can move without fixing even after being wound around a bobbin, therefore, the problem of variation in the heat shrinkage rate is unlikely to occur, and even if the constitution of the present invention is adopted, the effect obtained is smaller.

Further, in the method for manufacturing the wound yarn package 1 of the present embodiment, each yarn constituting the n-th (n is an integer of 2 or more) layer is wound at a position 0 to x mm away from each yarn constituting the (n−1)-th yarn layer, in the winding step, when the yarn width of the sea-island type fiber 3 is taken as x (mm). Specifically, a yarn $f_1$ on the first turn of the traverse is wound adjacent to a yarn $f_0$ at the start of winding or at a pitch p narrower than the yarn width x mm, and a yarn $f_2$ on the second turn of the traverse is wound adjacent to the yarn $f_1$ on the first turn or at a pitch p narrower than the yarn width x mm.

At that time, each yarn is guided, for example, by a traverse guide, and wound. From the viewpoint of suppressing cob-webbing and curling and reducing variation in the heat shrinkage rate in the yarn layer, the distance (pitch p) between the yarn in the n-th layer and the yarn in the (n−1)-th layer is preferably not larger than half of the yarn width x (mm), that is, 0 to 0.5 x mm.

Further, the winding angle of the sea-island type fiber 3 to the bobbin 2, that is, the twill angle θ is not particularly limited, but in the case of a wound yarn package having a constant winding number, it is preferable that the twill angle is reduced sequentially from the start to the end of winding, so that the difference between the twill angles at the start and the end of winding is 4° to 7°.

Further, if the twill angle θ is increased, the probability of occurrence of cob-webbing can be lowered, but there is a problem that curling is likely to occur. On the other hand, if the twill angle is made small, it is difficult to get curling, but the cob-webbing is easy to occur. Therefore, it is preferable to apply a technique called a wind step in which the winding number is changed so that the twill angle θ is constant from the start to the end of winding, for the wound yarn package 1 of the present embodiment. This makes it possible to reduce curling and a difference in heat shrinkage rate depending on the winding diameter.

Further, in the method for manufacturing the wound yarn package 1 of the present embodiment, the package may be put into an oven and the yarn layer formed on the bobbin 2 may be heated (after-cure), after the winding step. By performing after-cure, the passing resistance of rollers and the like is reduced at the time of drawing out in the weaving process, and the probability of troubles such as reeling failure and the like can be reduced. Here, the conditions for after-cure are not particularly limited and can be appropriately set according to the diameter and material of the yarn, and for example, the time can be 6 hours or more under a temperature condition of 40 to 120° C. In the wound yarn package of the present embodiment, no curling occurs in the lower layer yarn even after performing after-cure, since the sea-island type fiber is wound at a specific pitch.

As described in detail above, in the wound yarn package of the present embodiment, the distance (pitch p) between the n-th layer yarn and the (n−1)-th layer yarn is less than or equal to the yarn width x (mm), that is, from 0 to x mm, in winding sea-island type fibers around a bobbin one by one by a traverse mode, therefore, a wound yarn package can be obtained in which the unevenness on the surface of the yarn layer is reduced, cob-webbing and curling are less likely to occur, and the heat shrinkage rate of the yarn layer is uniform.

EXAMPLE

Figure 5:
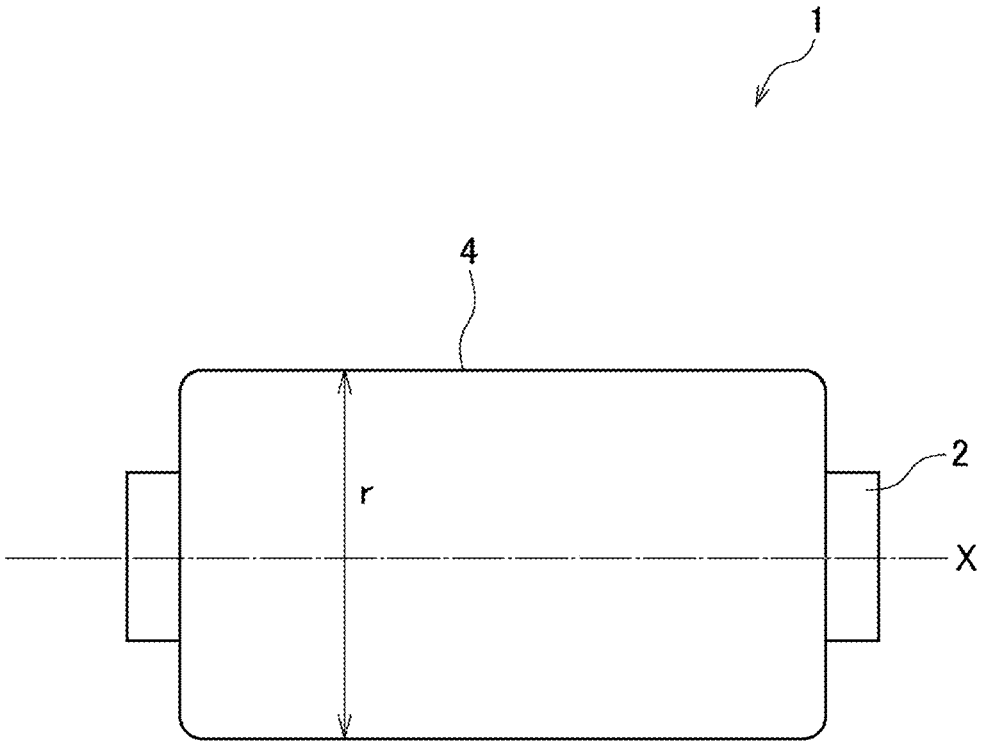
FIG. 5 is a schematic view showing the appearance of a wound yarn package according to an embodiment of the present invention.

Hereinafter, the effects of the present invention will be specifically described with reference to examples and comparative examples. In the present examples, wound yarn packages of examples and comparative examples were fabricated by methods and conditions shown below, and unwindability and physical properties thereof were evaluated. FIG. 5 is a schematic view showing the appearance of the wound yarn package according to the example of the present invention.

Example 1

(1) Fabrication of Sea-Island Type Fiber

First, a sheath-core type composite fiber shown in FIG. 3A was formed using ethylene-polypropylene random copolymer (CoPP) having a melting point of 134° C. as a sheath component and polyethylene terephthalate (PET) having a melting point of 256° C. as a core component, and a tape-shaped sea-island type fiber shown in FIG. 2A was fabricated using this composite fiber (single fiber).

Specifically, a sheath-core type composite fiber was spun at a spinning speed of 66.2 m/min using a sheath-core concentric type composite nozzle having 120 nozzle holes by a conventional heat-melt composite spinning device. Subsequently, the stretching temperature was set to 100° C. and the stretching speed was set to 274.0 m/min, and heat stretching was performed between the rollers under these conditions, and further, the fibers were brought into contact with a heated Nelson roller at 158° C. at the same speed and only CoPP, which is a low melting point component, was melted to integrate single fibers, to obtain a tape-shaped sea-island type fiber having a fineness of 800 dtex and a yarn width of 1.20 mm (2) Winding Next, using a winder equipped with a traverse device, the tape-shaped sea-island type fibers produced by the above-mentioned method were wound around the bobbin 2 one by one using a traverse guide. A paper tube having an outer diameter of 108 mm and a length of 330 mm was used as the bobbin 2 for winding, and a traverse guide having a groove width of 1.2 mm was used.

As for the winding conditions, the winding number was 5.012 times/traverse width (280 mm), and the winding pitch in the first lap after one traverse turn was 1.21 mm (the distance between the n-th layer yarn and the (n−1)-th layer yarn was 0.01 mm), the winding speed was 275 m/min, the winding diameter r was 155 mm, the winding start twill angle θs was 10.17°, the winding end twill angle θe was 7.12°, and the twill angle difference (θs−θe) was 3.05°. Then, after winding until the mass of the yarn layer 4 became 4.5 kg, the package was held in an oven at 100° C. for 12 hours for after-cure, to obtain a wound yarn package of Example 1 having the appearance shown in FIG. 5.

Example 2

A tape-shaped sea-island type fiber fabricated under the same materials, methods and conditions as in Example 1 was wound around the bobbin (paper tube) 2 in two stage winding number step, to fabricate a wound yarn package of Example 2. As for the winding conditions at that time, the winding number was 5.012 times/traverse width (280 mm), and the winding pitch p in the first lap after one traverse turn was 1.21 mm (the distance between the n-th layer yarn and the (n−1)-th layer yarn was 0.01 mm) in the first stage, and the winding number was 4.512 times/traverse width (280 mm), and the winding pitch p in the first lap after one traverse turn was 1.21 mm (the distance between the n-th layer yarn and the (n−1)-th layer yarn was 0.01 mm) in the second stage. The winding diameter r was 154 mm, the winding start twill angle θs was 10.17°, the winding end twill angle θe was 7.95°, and the twill angle difference (θs−θe) was 2.22°.

Example 3

(1) Fabrication of Sea-Island Type Fiber

A sea-island type fiber having an elliptical cross section shown in FIG. 2B was fabricated from the sheath-core type composite fiber shown in FIG. 3A, using linear low-density polyethylene (LLDPE) having a melting point of 112° C. as the sheath component and polypropylene (PP) having a melting point of 165° C. as the core component, Specifically, a sheath-core type composite fiber was spun at a spinning speed of 61.5 m/min using a sheath-core concentric type composite nozzle having 480 nozzle holes by a conventional heat-melt composite spinning device. Subsequently, the stretching temperature was set to 150° C. and the stretching speed was set to 800 m/min, and stretching was performed in a steam tank under these conditions and only LLDPE, which is a low melting point component, was melted to integrate the fibers, to obtain a sea-island type fiber having an elliptical cross section having a fineness of 2000 dtex and a yarn width of 1.00 mm (2) Winding Next, using a winder equipped with a traverse device, the sea-island type fibers having an elliptical cross section fabricated by the above-mentioned method were wound around the bobbin 2 one by one using a traverse guide. A paper tube having an outer diameter of 108 mm and a length of 330 mm was used as the bobbin 2 for winding, and a traverse guide having a groove width of 1.2 mm was used.

As for the winding conditions, the winding number was 4.011 times/traverse width (280 mm), and the winding pitch in the first lap after one traverse turn was 1.02 mm (the distance between the n-th layer yarn and the (n−1)-th layer yarn was 0.02 mm), the winding speed was 785 m/min, the winding diameter r was 265 mm, the winding start twill angle θs was 12.63°, the winding end twill angle θe was 5.22°, and the twill angle difference (θs−θe) was 7.41°. Then, after winding until the mass of the yarn layer 4 became 6.5 kg, the package was held in an oven at 40° C. for 48 hours for after-cure, to fabricate a wound yarn package of Example 3.

Example 4

A sea-island type fiber fabricated under the same materials, methods and conditions as in Example 1 was wound under the same conditions as in Example 1, except that the winding number was 5.019 times/traverse width (280 mm), the winding pitch p in the first lap after one traverse turn was 1.80 mm (the distance between the n-th layer yarn and the (n−1)-th layer yarn was 0.60 mm), the winding start twill angle θs was 10.15°, the winding end twill angle θe was 7.11°, and the twill angle difference (θs−θe) was 3.04°, to fabricate a wound yarn package of Example 4.

Example 5

A sea-island type fiber fabricated under the same materials, methods and conditions as in Example 1 was wound under the same conditions as in Example 1, except that the winding number was 3.510 times/traverse width (280 mm), the winding start twill angle θs was 14.36°, the winding end twill angle θe was 10.11°, and the twill angle difference (θs−θe) was 4.25°, to fabricate a wound yarn package of Example 5.

Example 6

A sea-island type fiber fabricated under the same materials, methods and conditions as in Example 1 was wound under the same conditions as in Example 1, except that the winding number was 7.013 times/traverse width (280 mm), the winding pitch p in the first lap after one traverse turn was 1.20 mm (the distance between the n-th layer yarn and the (n−1)-th layer yarn was 0 mm), the winding start twill angle θs was 7.30°, the winding end twill angle θe was 5.10°, and the twill angle difference (θs−θe) was 2.2°, to fabricate a wound yarn package of Example 6.

Comparative Example 1

A sea-island type fiber fabricated under the same materials, methods and conditions as in Example 1 was wound under the same conditions as in Example 1, except that the winding number was 5.320 times/traverse width (280 mm), the winding pitch p in the first lap after one traverse turn was 31.05 mm (the distance between the n-th layer yarn and the (n−1)-th layer yarn was 29.85 mm), the winding start twill angle θs was 9.59°, the winding end twill angle θe was 6.71°, and the twill angle difference (θs−θe) was 2.88°, to fabricate a wound yarn package of Comparative Example 1.

Comparative Example 2

A sea-island type fiber fabricated under the same materials, methods and conditions as in Example 3 was wound under the same conditions as in Example 3, except that the winding number was 3.606 times/traverse width (280 mm), the winding pitch p in the first lap after one traverse turn was 65.00 mm (the distance between the n-th layer yarn and the (n−1)-th layer yarn was 64.00 mm), the winding start twill angle θs was 14.00°, the winding end twill angle θe was 5.80°, and the twill angle difference (θs−θe) was 8.2°, to fabricate a wound yarn package of Comparative Example 2.

Comparative Example 3

A sea-island type fiber fabricated under the same materials, methods and conditions as in Example 1 was wound under the same conditions as in Example 1, except that the winding number was 5.029 times/traverse width (280 mm), the winding pitch p in the first lap after one traverse turn was 2.80 mm (the distance between the n-th layer yarn and the (n−1)-th layer yarn was 1.60 mm), the winding start twill angle θs was 10.13°, the winding end twill angle θe was 7.098°, and the twill angle difference (θs−θe) was 3.032°, to fabricate a wound yarn package of Comparative Example 3.

[Evaluation]

Next, the wound yarn packages of Examples 1 to 6 and Comparative Examples 1 to 3 fabricated by the above-mentioned method were evaluated by methods shown below.

1. Physical Properties of Composite Fiber

<Width/Thickness>

For each of the wound yarn packages of examples and comparative examples, the width and thickness of each sea-island type fiber after being wound around a bobbin were measured with a digital caliper and a dial thickness gauge, respectively.

<Young's Modulus>

For each of the wound yarn packages of examples and comparative examples, three samples having a length of 300 mm were cut out from the outermost layer and the innermost layer of the yarn layer, respectively, and the Young's modulus was measured using a tensile measuring machine with a chuck distance of 200 mm, and the average value of the three samples was calculated.

<Heat Shrinkage Rate>

For each of the wound yarn packages of examples and comparative examples, three samples having a length of 1200 mm and a distance between marked lines of 1000 mm were cut out from the outermost layer and the innermost layer of the yarn layer, respectively. Then, each sample was cut into 1000 mm and held in a fine oven at 80° C. in a tension-free state for 30 minutes, and the shrinkage rate (average value of 3 pieces) was determined from the length before and after heating.

2. Unwindability

<Cob-Webbing>

When the appearance of each wound yarn package of examples and comparative examples was observed and a state in which the yarn has fallen over a length of 15 mm or more from the winding end of the bobbin, that is, a short drop (shortcut) state was confirmed, it was judged as "cob-webbing". On the other hand, when such a shortcut state was not observed, it was judged as "no cob-webbing".

Table 1 below shows the fabrication and winding conditions of the wound yarn packages of Examples 1 to 6 and Comparative Examples 1 to 3, and Table 2 shows the evaluation results of these wound yarn packages, respectively.

TABLE 1

| | | Example 1 | Example 2 | Example 3 | Example 4 | Example 5 | Example 6 | Comparative example 1 | Comparative example 2 | Comparative example 3 |
|---|---|---|---|---|---|---|---|---|---|---|
| Yarn | Kind | Tape-shaped | Tape-shaped | Elliptical cross section | Tape-shaped | Tape-shaped | Tape-shaped | Tape-shaped | Elliptical cross section | Tape-shaped |
| | Material | Co-PP/PET | Co-PP/PET | LLDPE/PP | Co-PP/PET | Co-PP/PET | Co-PP/PET | Co-PP/PET | LLDPE/PP | Co-PP/PET |
| | Fineness (dtex) | 800 | 800 | 2000 | 800 | 800 | 800 | 800 | 2000 | 6400 |
| | Width (mm) | 1.20 | 1.20 | 1.00 | 1.20 | 1.20 | 1.20 | 1.20 | 1.00 | 1.20 |
| | Welding method | Heated Nelson | Heated Nelson | Steam tank stretching method | Heated Nelson | Heated Nelson | Heated Nelson | Heated Nelson | Steam tank stretching method | Heated Nelson |
| Winding conditions | Winding number −1 | 5.012 | 5.012 | 4.011 | 5.019 | 3.510 | 7.013 | 5.320 | 3.606 | 5.029 |
| | Pitch (mm) | 1.21 | 1.21 | 1.02 | 1.80 | 1.21 | 1.20 | 31.05 | 65.00 | 2.80 |
| | Winding number step | None | Present (2 stages) | None | None | None | None | None | None | None |

TABLE 1-continued

| | Example 1 | Example 2 | Example 3 | Example 4 | Example 5 | Example 6 | Comparative example 1 | Comparative example 2 | Comparative example 3 |
|---|---|---|---|---|---|---|---|---|---|
| Winding number −2 | — | 4.512 | — | — | — | — | — | — | — |
| Pitch (mm) | — | 1.21 | — | — | — | — | — | — | — |
| Winding diameter (mm) | 155 | 154 | 265 | 155 | 155 | 155 | 155 | 265 | 155 |
| Winding start twill angle θs (°) | 10.17 | 10.17 | 12.63 | 10.15 | 14.36 | 7.30 | 9.59 | 14.00 | 10.13 |
| Winding end twill angle θe (°) | 7.12 | 7.95 | 5.22 | 7.11 | 10.11 | 5.10 | 6.71 | 5.80 | 7.098 |
| Twill angle difference (θs − θe) | 3.05 | 2.22 | 7.41 | 3.04 | 4.25 | 2.2 | 2.88 | 8.2 | 3.032 |
| Heating conditions | 100° C. × 12 hr | 100° C. × 12 hr | 40° C. × 48 hr | 100° C. × 12 hr | 100° C. × 12 hr | 100° C. × 12 hr | 100° C. × 13 hr | 40° C. × 48 hr | 100° C. × 12 hr |

TABLE 2

| | | Example 1 | Example 2 | Example 3 | Example 4 | Example 5 | Example 6 | Comparative example 1 | Comparative example 2 | Comparative example 3 |
|---|---|---|---|---|---|---|---|---|---|---|
| evaluation | Cob-webbing | None | None | None | None | None | None | Observed | Observed | Observed |
| | Young's modulus/outermost layer (cN/dtex) | 44.8 | 45.0 | 102.0 | 45.0 | 44.8 | 45.0 | 45.0 | 100.0 | 44.9 |
| | Young's modulus/innermost layer (cN/dtex) | 44.3 | 44.9 | 101.0 | 43.2 | 44.4 | 44.8 | 38.3 | 91.0 | 41.1 |
| | Heat shrinkage rate/outermost layer (%) | 0.01 | 0.01 | 1.05 | 0.01 | 0.01 | 0.0 | 0.01 | 1.04 | 0.01 |
| | Heat shrinkage rate/innermost layer (%) | 0.01 | 0.01 | 1.07 | 0.01 | 0.01 | 0.01 | 0.08 | 1.81 | 0.07 |
| | Heat shrinkage rate difference (%) | 0.0 | 0.0 | 1.9 | 0.0 | 0.0 | 0.0 | 700.0 | 74.0 | 600.0 |

As shown in Tables 1 and 2 above, in all of the wound yarn package of Comparative Example 1 wound at a wide pitch like the conventional product and the wound yarn package of Comparative Example 3 wound at a narrower pitch than Comparative Example 1 but is outside the scope of the present invention, cob-webbing was observed, and further, curling occurred in the lower layer, resulting in variations in Young's modulus and heat shrinkage rate in the yarn layer. Further, in the wound yarn package of Comparative Example 2 using the yarn having an elliptical cross section, winding was performed at a pitch wider than the yarn width likewise, thus, cob-webbing was observed, and curling occurred in the lower layer, resulting in variations in Young's modulus and heat shrinkage rate in the yarn layer.

On the other hand, in the wound yarn packages of Examples 1 to 6 manufactured within the scope of the present invention, no cob-webbing was observed, and the physical properties (Young's modulus/heat shrinkage rate) in the yarn layer were uniform. It was confirmed from the above results that a wound yarn package is obtained in which cob-webbing and curling are less likely to occur and physical properties such as heat shrinkage rate and Young's modulus do not vary between layers constituting the yarn layer, even if sea-island type fibers are wound around a bobbin one by one by a traverse mode, according to the present invention.

REFERENCE SIGNS LIST

1 wound yarn package
2 bobbin
3 sea-island type fiber
4 yarn layer
31 low melting point component
32 high melting point component
33*a*, 33*b*, 33*c* composite fiber
$f_0$ to $f_2$ yarn
r winding diameter
p pitch
x yarn width
θ twill angle

The invention claimed is:

1. A wound yarn package comprising
a bobbin, and
yarn layers comprising layers of a single yarn wound around the bobbin in a traverse mode, wherein each yarn constituting the n-th yarn turn, where n is an integer of 2 or more, is wound at a position 0 to 0.5 x mm away from each yarn constituting the (n−1)-th yarn turn, with the yarn width of the single yarn being taken as x mm, wherein the single yarn is a sea-island type fiber having a tape-shape or an elliptical cross-section, formed by integrating dozens to hundreds of melt-spun single fibers having at least two different melting points by fusion or heat welding into the single yarn including a sea component and an island component, wherein the sea-island type fiber has a heat shrinkage rate of 2% or less at a temperature lower by 20° C. than the melting point of the sea component, and has a fineness ranging from 100 to 6400 dtex.

2. A method for manufacturing a wound yarn package comprising a winding step for winding an n-th turn of a single yarn at a position 0 to x mm away from the single yarn constituting the (n−1)-th yarn turn, wherein n is an integer of 2 or more and a yarn width of the single yarn is 0.5 x mm, wherein the single yarn is a sea-island type fiber having a tape-shape or an elliptical cross-section, formed by integrating dozens to hundreds of melt-spun sea-island type fibers having at least two different melting points by fusion or heat welding into the single yarn including a sea component and an island component, wherein the single fiber has a heat shrinkage rate of 2% or less at a temperature lower by 20° C. than the melting point of the sea component, and has a fineness ranging from 100 to 6400 dtex.

3. The method for manufacturing a wound yarn package according to claim 2, further comprising a heating step for heating layers of the single yarn for 6 hours or more under a temperature condition of 40 to 120° C. after the winding step.

* * * * *